United States Patent [19]

Greco et al.

[11] 4,261,120

[45] Apr. 14, 1981

[54] ELECTRIC PRESSING IRON HAVING INDICATING READY LIGHT WITH IMPROVED SWITCH MEANS

[75] Inventors: Robert W. Greco, Waterbury; Carl D. McArthur, Winsted, both of Conn.

[73] Assignee: Scovill Inc., Waterbury, Conn.

[21] Appl. No.: 917,172

[22] Filed: Jun. 20, 1978

[51] Int. Cl.[3] ..... D06F 75/26; H05B 1/02

[52] U.S. Cl. ..... 38/82; 219/248; 219/506

[58] Field of Search ..... 38/82, 77.7, 77.83; 219/246, 248, 506, 515

[56] References Cited

U.S. PATENT DOCUMENTS

| | | | |
|---|---|---|---|
| 2,527,775 | 10/1950 | Sutton | 219/506 X |
| 2,593,812 | 4/1952 | Turner | 219/248 |
| 2,778,913 | 1/1957 | Finlayson | 219/506 |
| 2,786,990 | 3/1957 | Garner | 219/506 X |
| 3,035,144 | 5/1962 | Kircher | 219/506 X |
| 4,029,940 | 6/1977 | Eaton et al. | 219/248 X |

*Primary Examiner*—Louis Rimrodt
*Attorney, Agent, or Firm*—Dallett Hoopes

[57] ABSTRACT

Ready light circuit is provided which comprises a simple third switch blade added to the standard thermostat two-blade switch in an electric iron. The invention involves the improvement of mounting the third blade on one of the other blades of the two-blade switch.

2 Claims, 14 Drawing Figures

HEATING

ON TEMPERATURE

OVERSHOOT

COOLING

ELECTRIC PRESSING IRON HAVING INDICATING READY LIGHT WITH IMPROVED SWITCH MEANS

CROSS REFERENCES TO RELATED APPLICATION

This application relates to an invention which is an improvement on the invention disclosed in U.S. patent application Ser. No. 810,502, filed June 27, 1977, now abandoned by George Wallace Robinson and assigned to our assignee.

BACKGROUND OF THE INVENTION

1. Field of the Invention

This invention relates to an electric pressing iron having a ready light for indicating when the soleplate of the iron is in the temperature range for which the temperature control has been set. More specifically, the invention relates to an electric pressing iron having an indicator light circuit including extremely simple switch means which accurately reflect the condition of the iron, are capable of simple factory adjustment, and are foolproof in operation.

2. Description of the Prior Art

The prior art includes U.S. patent application Ser. No. 810,502, filed June 27, 1977, upon which the present invention is an improvement. That application disclosed an electric pressing iron having a ready light which would go on to indicate that the temperature of the iron was in the desired temperature range. The ready light would not go on while the soleplate was being heated because during that time the soleplate might well be below the operating temperature selected. Also, the ready light would not go on if the soleplate was of too hot a temperature as when the shift is made between a linen/wool setting down to a cooler new setting for synthetics. The earlier above-identified application was indeed meritorious and has been put into practice.

SUMMARY OF THE INVENTION

In the prior device described above, aberrations in the contact arrangement in the ready light circuit have been required. Under the present arrangement, it has been discovered that such aberrations can be avoided if the third blade, part of the ready light circuit, is mounted directly on one of the other two contact blades so that it moves with that contact blade.

BRIEF DESCRIPTION OF THE DRAWING

Other objects and features of the invention will be apparent from a reading of the following specification and reference to the attached drawings, all of which comprise a disclosure of a non-limiting embodiment of the invention. In the drawings.

DESCRIPTION OF THE PREFERRED EMBODIMENT

Figure 1:
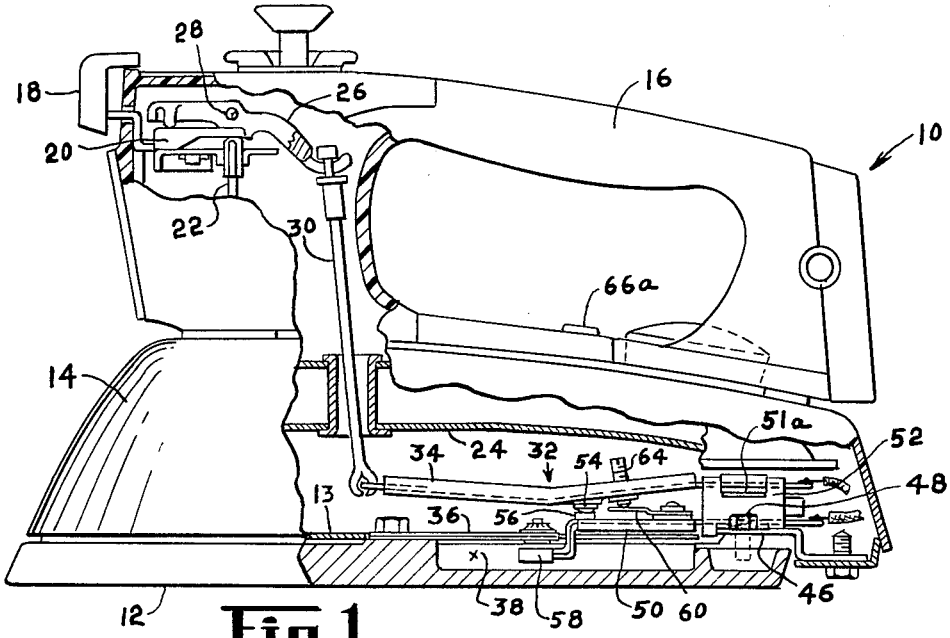
FIG. 1 is an elevational view of a pressing iron embodying the invention, the iron being broken away in parts to reveal operative parts thereof.

Referring more specifically to the drawings, an iron embodying the invention is generally designated 10 in FIG. 1. Outwardly it comprises a cast soleplate 12 with cover 13 (FIG. 2) superposed by a conventional sheetmetal skirt 14 over which is mounted a handle 16, a front portion of which is hollow, as shown, to accommodate various working parts. A light window 66*a* is formed in the housing under the handle.

A temperature setting lever 18 is disposed external of the handle and is pivoted to structure inside the handle and adapted to rotate a cam 20. As is conventional, the cam operates a steam control valve 22 permitting water to be dispensed from a tank 24 onto the inside of the soleplate 12 which is perforated (not shown) for the purpose of venting steam.

Also operated by the cam 20 in a well-known manner is are 26 pivoted at 28 and attached at its rearward end to a temperature element setting link 30.

Mounted on the top of the soleplate 12 towards the rear of the iron is a switch assembly 32 which includes a forwardly cantilevered sheetmetal upper blade 34, the distal end of which is engaged by the link 30. Thus, by manipulating the lever 18, the height of the distal end of the blade 34 may be raised or lowered and set at a desired level to effect a desired temperature setting of the iron. Blade 34 cooperates with other structure in the switch assembly 32 to effect the activation and deactivation of the iron heater to achieve the desired temperature.

Included in the conventional iron temperature control switch assembly is the bimetallic element 36 mounted at one end to the soleplate and cantilevered out over a recess 38 in the soleplate in the opposite direction from the switch blade 34. The distal end of the bimetallic element is formed with an opening penetrated by a headed element 40, the head being disposed on the underside of the element 36.

Still more specifically, the switch assembly 32 is rivetted as at 44 to a plate 46 which, as shown, is bolted at 48 (FIG. 1) to the soleplate. The assembly includes a sheetmetal lower blade 50 insulated from the rivet 44 and plate 46, and an insulation block 52, preferably ceramic.

Figure 5:
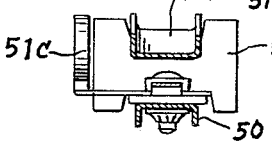
FIG. 5 is a fragmentary sectional view taken on the line 5—5 of FIG. 2.

The upper blade 34 and the lower blade 50 carry contact buttons 54 and 56, respectively. The lower blade 50 is biased upward by its natural resilience and carries a downwardly offset dog-leg portion 58. The upper surface of the offset portion 58 continuously engages the head of the element 40. As shown (FIG. 5), the blades 34 and 50 may be channel-shaped to stiffen them, the upward bias of the blade being achieved at a section 50*a* thereof immediately adjacent the block 52. The outer end of the blade 34 may be deflected at an elbow 34*a* as shown and terminate in an insulated section 34*b* which is apertured and receives the end of the link 30.

The operation of the structure as shown before is conventional depending upon the setting of lever 18 and in turn the height of the end 34*b* of blade 34, and depending on the disposition of the bimetallic element 36, that is, whether it holds the offset portion 58 down or not, the buttons 54, 56 contact or not to activate or deactivate the circuit including the heading element H.

Figure 3:
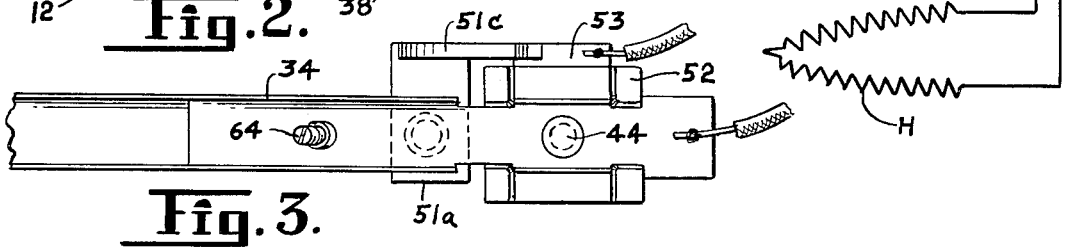
FIG. 3 is a plan view of a portion of the switch taken on the line 3—3 of FIG. 2.
Figure 4:
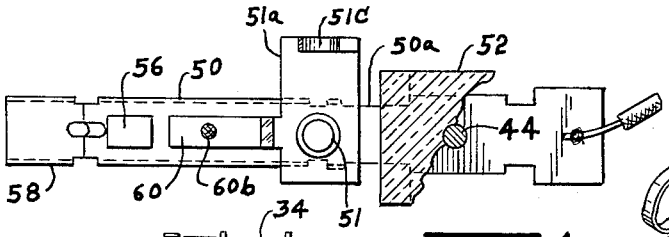
FIG. 4 is a fragmentary sectional view taken on the line 4—4 of FIG. 2.

Attention is now focused on the light circuit and components. The insulating block 52 (FIG. 3) electrically insulates and mounts the inner ends of blades 50 and 34. The terminal plate 53 rests on the block 52 and is superposed by an insulating layer 55 which is in turn superposed by the inner end of blade 34. Note that the plate 53 is apertured generously about the clamping rivet 44 so as to not contact it. The circuit is as shown schematically.

Figure 2:
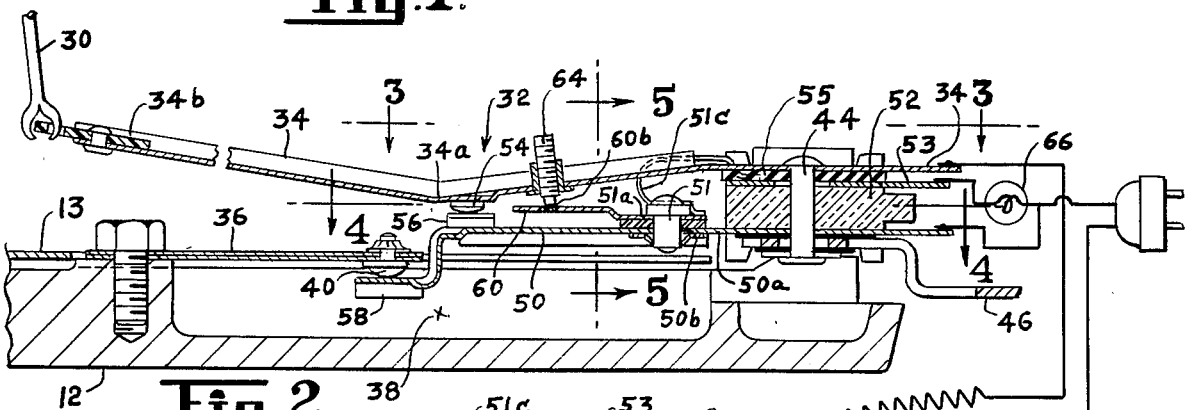
FIG. 2 is an enlarged sectional view of the switch and including a schematic diagram of the iron heating an indicating light circuit.
Figure 6:
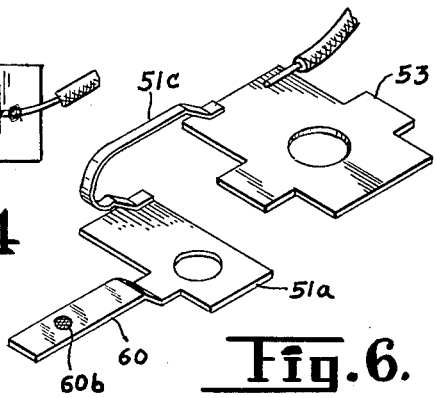
FIG. 6 is a perspective view of the terminal plate third blade assembly.

As shown in FIG. 2, blade 50 is apertured at 50*b* and receives a rivet 51 which secures to blade 50 the metal strip 51*a* with its outwardly extending blade 60 having the offset 51*b* (FIG. 6). Insulation means surround the rivet 51, as shown, to isolate the base 51*a* electrically from the blade 50. A flexible lead 51*c* connects the base 51*a* and the plate 53. As shown, the blade 60 extends more or less parallel to the blade 50 and moves up and down as the blade 50 which carries it flexes at 50*a*.

Blade 60 carries a contact area 60*b* which engages the adjustable contact screw 64 (FIG. 2) as will be described.

Figure 14:
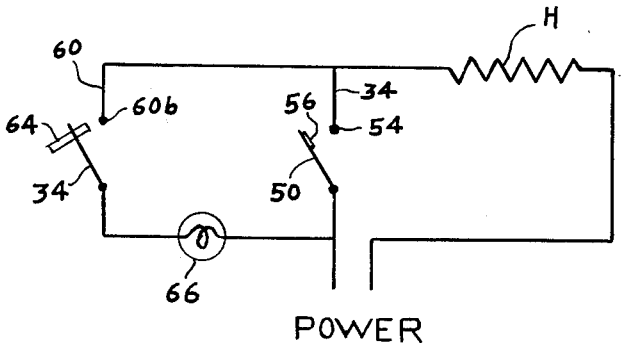
FIG. 14 is a circuit diagram.

It will be noted from the circuit diagram of FIG. 14 that the switch blades 34 and 50 (contacts 54,56) are in series with the heater H across the power line. The light 66 is in series with the blades 60 and 34 (contacts 64, 60*b*) and across the blades 34 and 50 (contacts 54, 56). As a result, the light 66, which in the iron is disposed visibly behind the window 66*a* (FIG. 1), only lights when the contacts 64, 60*b* are closed and the heater switch 34, 50 (contacts 54, 56) is open, for when the latter is closed it shorts across the light and blades 34 and 60 (contacts 64, 60*b*). This arrangement equates to the light lighting when the iron reaches the set temperature and remaining on until the temperature drops sufficiently to cause the blades 34, 50 to close at 54, 56 activating the heater. Thus, in other words, the light is on when the soleplate is at the desired "ready" temperature.

The operation of the structure so far described will be apparent from reference to FIGS. 7 through 12. In the first place, it must be understood that the bimetallic element 36 reflects the temperature it sees and the distal end thereof is at a higher level the cooler the temperature, and at a lower level the hotter the temperature it sees.

From the drawings 7 through 13, it will be apparent that the setting of the distal end of the blade 34 which is accomplished by lever 18 through linkage 30, is highest for the "off" position and then progresses downwardly the higher the temperature for which the iron is set. For convenience, it is indicated diagramtically in FIGS. 7 through 13 by the indications "Off", "L" for low or cooler setting, "H" for high or hot setting. With the above in mind, it will be noted that at the "off" setting, the blade 34 is high and the contact buttons 54 and 56 do not engage, the heater H not being energized. Similarly, the third blade 60, moving with blade 50, does not engage the contact 64. The lamp 66 is off.

Figure 8:
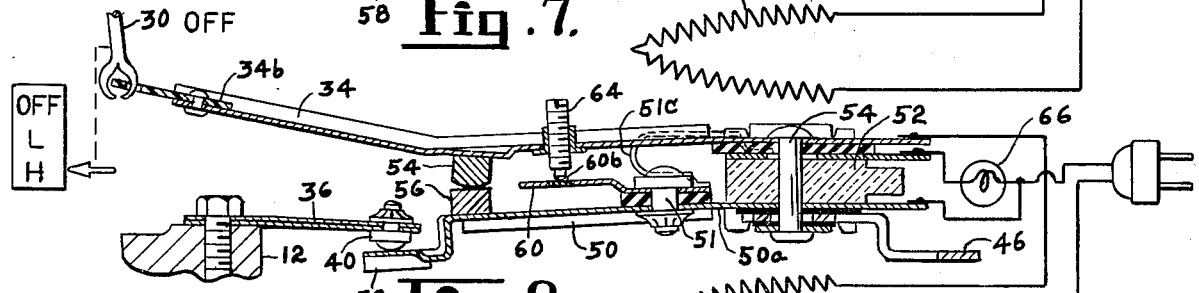
Figure 9:
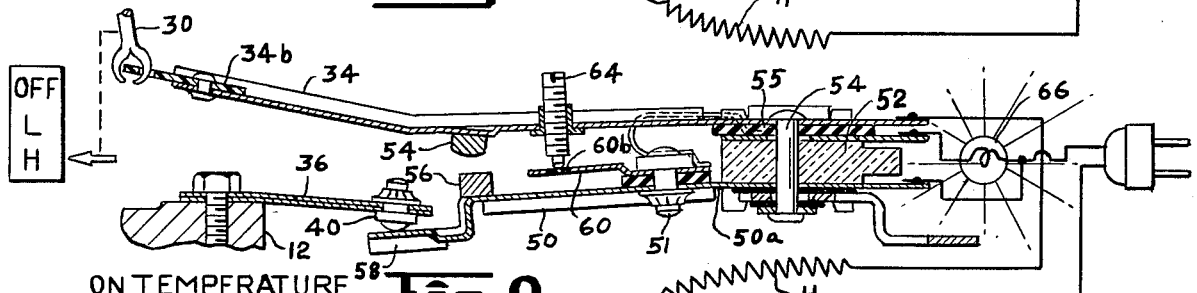

In FIG. 8, the setting has been moved to "high" which lowers the distal end of the blade 34 to the point where the buttons 54 and 56 contact, activating the heater H. While contact 64 and point 60*b* engage, the light does not light because the buttons 54, 56 in contact close the heater to short out the light.

As time passes and the iron heats (FIG. 9), the distal end of the bimetallic element 36 drops, driving down the blade 50 and thereby separating the contacts 54, 56. This lowering causes the blade 60 mounted on element 50 also to lower, but because of the natural bias of the blade 60 at its bend adjacent its mounting, the contact point 60*b* still engages the contact 64. Thus, with the heater H off and contacts 64, 60*b* closed, the light 66 is activated indicating that the iron has arrived at the set temperature.

Figure 7:
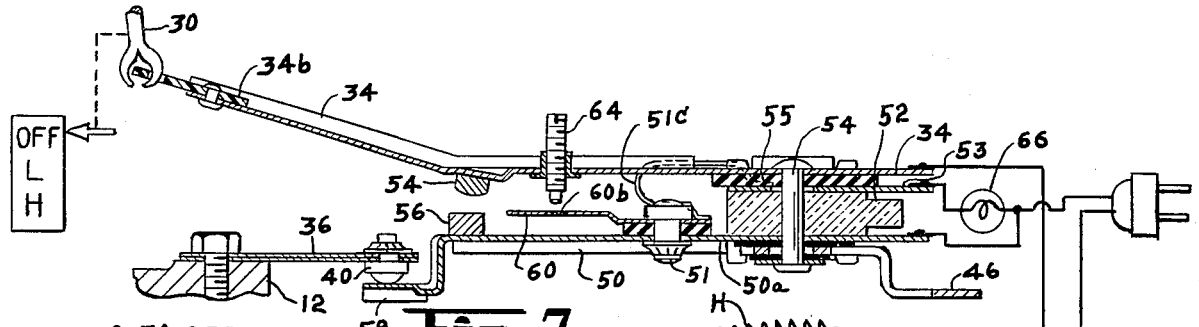
FIGS. 7 through 13 are views comparable to portions of FIG. 2 showing the position of the various elements under conditions as described in the specification herebelow.

It will be understood that were the iron to initially be set from the "off" position to an "L" position, the operation would be substantially the same except that because arm 34 and button 54 would be at a slightly higher level than that shown in FIG. 7, the bimetallic element 36 would not need to lower as much for deactivation of heater H as for an "H" setting.

Figure 10:
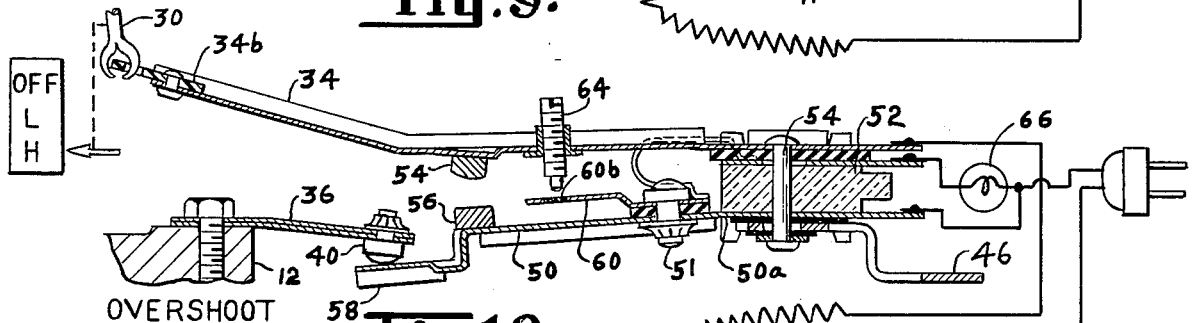

FIG. 10 depicts the "overshoot" condition in which the temperature of the soleplate continues for a short time to rise after the heater is cut off. The continued rise is due to the inertia or heat momentum of the mass of the heater and the soleplate before the ambient temperature prevails to start to cool the mass again. This phenomenon is comparable to the continued rise of a rocket for a moment after its engines have been shut off. In the overshoot condition, the bimetallic element permits the continued lowering of the blade 60 to the shown condition (FIG. 10) in which contact 64 and point 60*b* disengage, deactivating the light 66 to warn the user not to use the iron because its soleplate is above the preset temperature.

Figure 11:
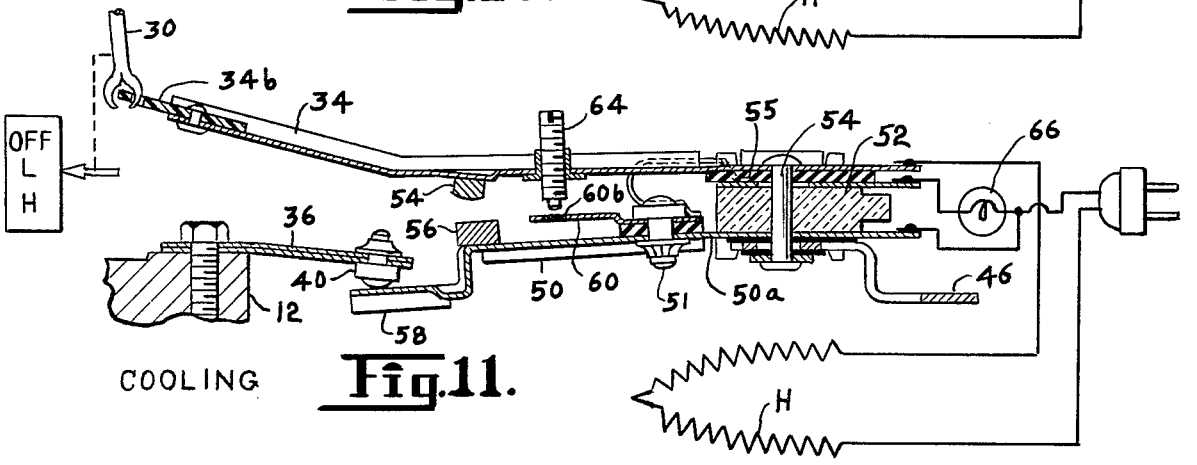
Figure 12:
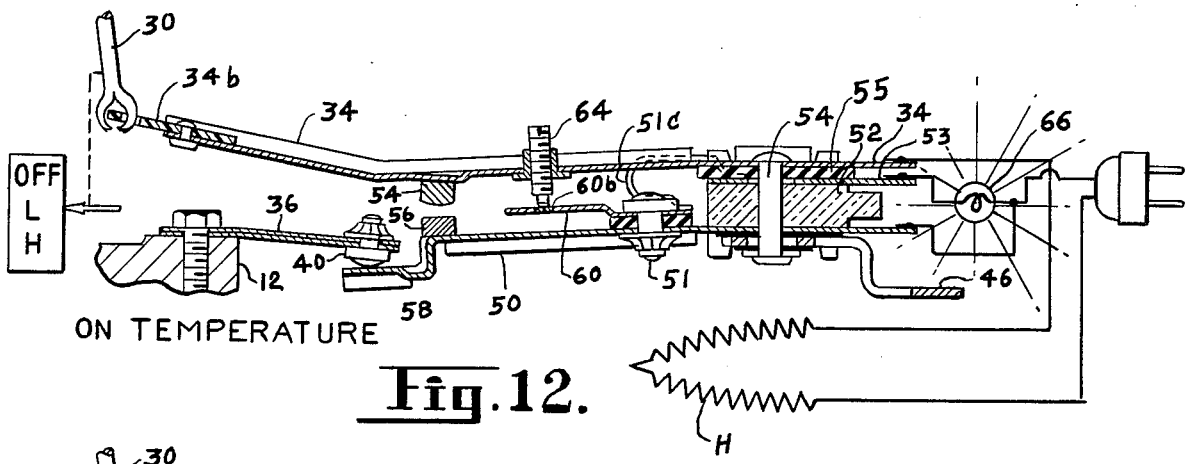
Figure 13:
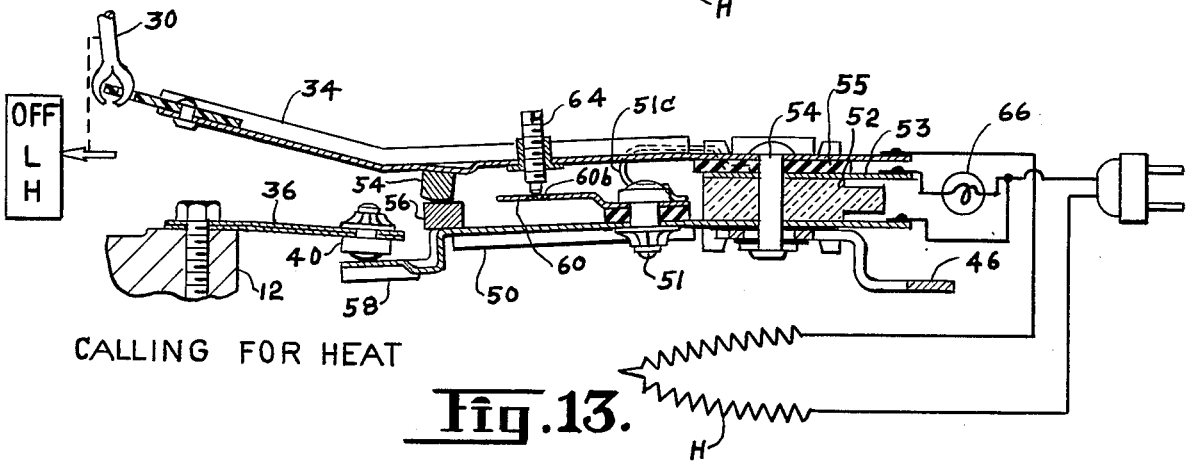

FIG. 11 depicts the condition of the parts after the temperature of the iron has been at high and the temperature setting has been changed from "high" to "low". This would be the case, for instance, if the user were to switch from ironing wools or linens to ironing synthetics. Because the bimetallic element 36 is low (FIG. 11), the blade 50 is held down and the blade 60 is permitted to drop with the result that the heater is off, as is the lamp 66. The contacts 54, 56 do not engage and the contact 64 and contact 60*b* do not engage. To the user, the absence of the light means that the iron is not ready for operating at a temperature suitable for synthetics.

When the iron has cooled sufficiently (FIG. 12), the bimetallic element 36 rises permitting the blade 50 to rise and raising the blade 60. Before the contacts 54 and 56 close, the contact 64 will engage the contact point 60*b* activating the light 66 and indicating that the iron is ready to use at the new low temperature.

Subsequently (FIG. 13), as the temperature drops further, the bimetallic element 36 will rise further permitting the blade 50 to raise so that contacts 54 and 56 engage, activating the heater H and shorting out the light 66. The flexure of the blade 60 absorbs the further upward movement of the bimetallic element 36.

Subsequently (not shown), the iron will pick up heat with the activation of the heater H, driving the bimetallic element 36 downward to in turn lower blade 50 and disengage contacts 54, 56, deactivating the heater H and reactivating the lamp 66 as the contact 64 and point 60*b* stay engaged. This cycling is continued as long as the iron is maintained at the low setting.

It will thus be apparent that from a very minor modification of a conventional two-blade thermostat switch an iron may be provided with an effective ready light for indicating when the iron is at the desired temperature. It will be apparent that at the factory the setting of the light switch is accomplished by adjustment of the set-screw-type contact 64.

Variations of the arrangement described are possible, all within the scope of the invention which may be defined by the following claim language:

We claim:

1. In an electric pressing iron having a heater circuit, the iron having mounted on the top of its soleplate a temperature-sensitive switch comprising a pair of superposed, spaced aligned contact blades cantilever-mounted and extending in the same direction, the switch including an upper blade and a lower blade, the blades carrying aligned contact zones, a bimetallic element cantilever-mounted on the soleplate in heat exchange relation therewith an adapted to engage with its distal end the lower blade to move the distal end of said lower blade away from the upper blade in conditions of no-heat-demand to separate the contact zones, temperature control setting means on the iron including means to raise and lower the distal end of the upper blade, the heater circuit being operatively connected in series with the switch, and a ready light circuit including a third blade mounted cantilever-fashion and disposed between and generally aligned with the other blades, the upper blade and third blade having aligned contact points, the bimetallic element adapted in conditions approaching heat-demand to cause upward movement of the distal end of the third blade to adjacent the upper blade to close the contact points, the ready light and the contact points being operatively connected in series and across the contact zones of the upper and lower blades, the improvement whrerein the third blade is mounted on the upper side of the lower blade and the bimetallic element causes upward movement of the distal end of the third blade by permitting the lower blade to raise.

2. An electric pressing iron as claimed in claim 1 wherein the contact point on the upper blade is in the form of an adjustable contact screw.

* * * * *